US010234800B2

(12) United States Patent
Okuzumi

(10) Patent No.: US 10,234,800 B2
(45) Date of Patent: Mar. 19, 2019

(54) CONTROL DEVICE AND IMAGE FORMING APPARATUS

(71) Applicant: CANON KABUSHIKI KAISHA, Tokyo (JP)

(72) Inventor: Ryo Okuzumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 15/372,004

(22) Filed: Dec. 7, 2016

(65) Prior Publication Data

US 2017/0168434 A1 Jun. 15, 2017

(30) Foreign Application Priority Data

Dec. 9, 2015 (JP) ..... 2015-240229

(51) Int. Cl.

| | |
|---|---|
| ***G03G 15/20*** | (2006.01) |
| ***G03G 15/00*** | (2006.01) |
| *G03G 21/20* | (2006.01) |

(52) U.S. Cl.
CPC ..... *G03G 15/2039* (2013.01); *G03G 15/80* (2013.01); *G03G 21/206* (2013.01)

(58) Field of Classification Search
CPC ... G03G 15/80; G03G 15/2039; G03G 21/206
See application file for complete search history.

(56) References Cited

FOREIGN PATENT DOCUMENTS

JP 2010-175814 8/2010

*Primary Examiner* — David M. Gray
*Assistant Examiner* — Andrew V Do
(74) *Attorney, Agent, or Firm* — Venable LLP

(57) ABSTRACT

A control device includes a controller configured to receive either one of a periodical first signal and a non-periodical second signal at a single port thereof. Depending on a state of the second signal, the controller switches first control for effecting control synchronized with the first signal and second control for effecting control synchronized with a predetermined cyclic period on the basis of a cyclic period of the first signal.

19 Claims, 6 Drawing Sheets

(a)

(b)

(a)

(b)

CONTROL DEVICE AND IMAGE FORMING APPARATUS

FIELD OF THE INVENTION AND RELATED ART

The present invention relates to a control device in a circuit constitution using a plurality of detecting signals and an image forming apparatus including the control device.

Conventionally, in the image forming apparatus such as a laser beam printer or the like, a cyclic period of a commercial power source and an output of a signal from a photosensor or the like are detected in general by providing CPU or SoC (system-on-a-chip) with an input port. For example, there is an image forming apparatus in which heat is generated by applying a commercial power source voltage to a heating member for fixing a toner image formed on a recording material. In this image forming apparatus, a detecting member for detecting a commercial power source (cyclic) period is provided and for example, a photo-triac coupler is turned on and off on the basis of the commercial power source period, so that an AC voltage is applied and control of supplied electric power is effected (see, Japanese Laid-Open Patent Application 2010-175814). By detecting the commercial power source period, on/off timing of the photo-triac coupler can be synchronized with the commercial power source period. For this reason, a positive/negative symmetry, of the AC voltage applied to a fixing device, which is determined IEC61000 (international standard about electromagnetic compatibility) can be ensured.

Recently, in order to satisfy a high-performance function, the number of sensors or detecting members provided in the image forming apparatus has increased, so that the number of ports necessary for the CPU and the SoC also increases. However, increases in size of packages of the CPU and the SoC and in the number of pins for increasing the number of ports lead to increases in cost and substrate area. Accordingly, a reduction in the number of ports of the CPU and the SoC has been required. As one of methods of reducing the number of ports, there is a method in which a port is used for two or more signals and is detected.

In a circuit constitution as shown in (a) of FIG. 6, two signals consisting of a periodical signal S11 and a level signal S12 are inputted into a single input port and are used as a multi-function signal in some cases. This signal inputted into a controller 10 is a multi-function signal S13. The periodical signal S11 is inputted into a base terminal of a transistor Tr1, an emitter terminal of the transistor Tr1 is grounded, and a collector terminal is connected with a signal line of the multi-function signal S13. The level signal S12 is inputted into a base terminal of a transistor Tr2, an emitter terminal of the transistor Tr2 is grounded, and a collector terminal is connected with the signal line of the multi-function signal S13. A timing chart of (b) of FIG. 6 shows states of the periodical signal S11, the level signal S12 and the multi-function signal S13 from above. When an output of the level signal S12 is a low level, the multi-function signal S13 outputs a signal depending on the periodical signal S11, and therefore the controller 10 can detect the periodical signal S11. However, in a period Td in which an output of the level signal S12 is a high level, even when the periodical signal S11 is normally outputted, the transistor Tr2 is turned on and thus the multi-function signal S13 is a low level, so that a low level signal is inputted into the controller 10. As a result, in the period Td in which the controller 10 originally should detect the periodical signal S11, the controller 10 cannot detect the periodical signal S11.

For example, in the case where supplied electric power of the fixing device is controlled in the laser beam printer as the image forming apparatus, a period of the commercial power source is detected and on/off control of the photo-triac coupler based on the period is executed. A port for detecting the period and a port for detecting a level signal such as a signal output are used as a (single) multi-function port, a period Td in which the periodical signal cannot be detected due to a change in signal output generates. In this period Td, the on/off timing of the photo-triac coupler cannot be determined, and therefore, a period in which the control cannot be continued generates. That is, there is a liability that a possibility that an operation of the fixing device becomes unstable occurs.

SUMMARY OF THE INVENTION

The present invention enables continuation of control even in the case where a non-periodical signal is inputted when control using a periodical signal is effected in a constitution in which the periodical signal and the non-periodical signal are inputted into a single input port of a control means.

According to an aspect of the present invention, there is provided a control device comprising: a controller configured to receive either one of a periodical first signal and a non-periodical second signal at a single port thereof, wherein depending on a state of the second signal, the controller switches first control for effecting control synchronized with the first signal and second control for effecting control synchronized with a predetermined cyclic period on the basis of a cyclic period of the first signal.

According to another aspect of the present invention, there is provided an image forming apparatus for forming an image on a recording material, comprising: a controller configured to receive either one of a periodical first signal and a non-periodical second signal at a single port thereof, wherein depending on a state of the second signal, the controller switches first control for effecting control synchronized with the first signal and second control for effecting control synchronized with a predetermined cyclic period on the basis of a cyclic period of the first signal.

Further features of the present invention will become apparent from the following description of exemplary embodiments with reference to the attached drawings.

DESCRIPTION OF THE EMBODIMENTS

Embodiments of the present invention will be described specifically with reference to the drawings.

Embodiment 1

Embodiment 1 will be described.

[Image Forming Apparatus]

Figure 1:
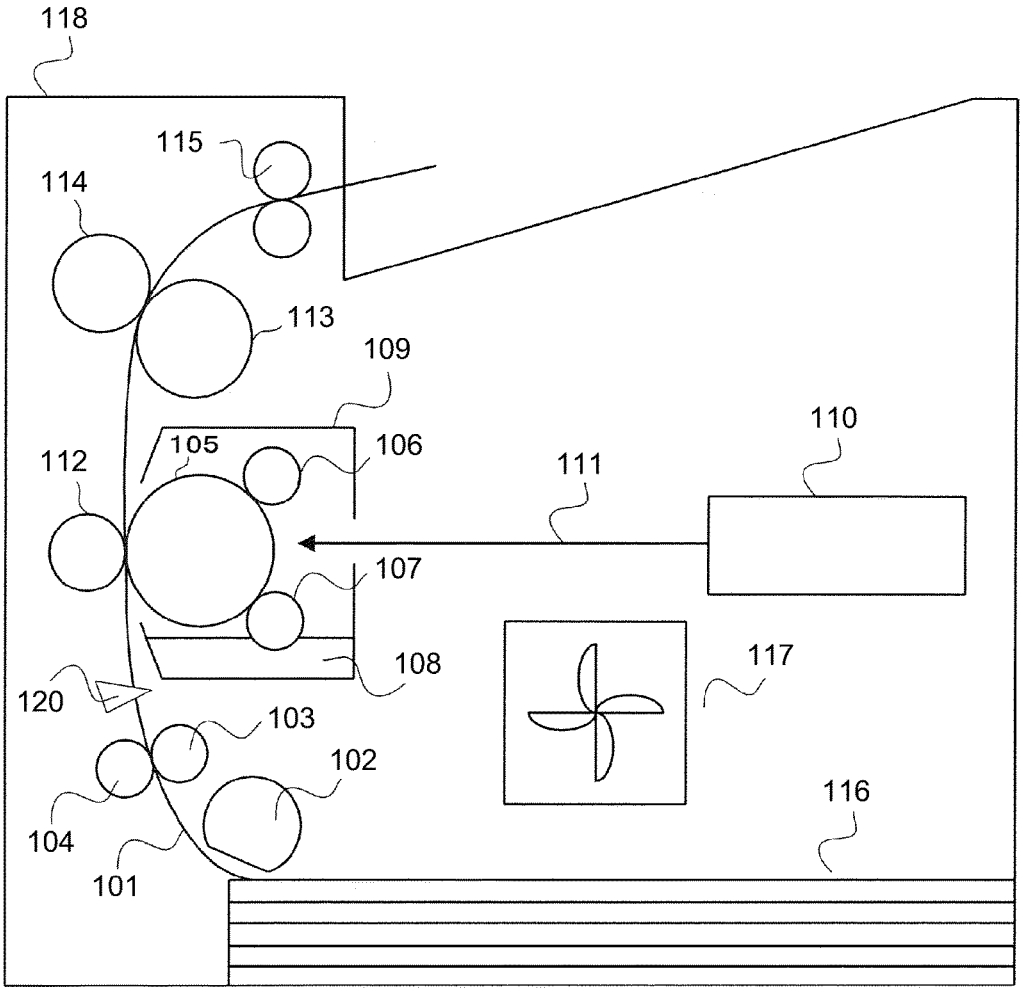
FIG. 1 is an illustration showing a structure of a laser beam printer in Embodiments 1 to 3.

The present invention relates to a control device, but in this embodiment, an example in which the control device of the present invention is applied to, e.g., a laser beam printer using an electrophotographic process will be described. FIG. 1 shows an example of a structure of a laser beam printer 118. In the printer 118, when printing is started, a sheet 101 as a recording material (medium) is picked up from a sheet feeding portion 116 by a sheet feeding roller 102 and is conveyed by conveying rollers 103, 104. When conveyance (feeding) of the sheet 101 is started, a leading end and a trailing end of the sheet 101 are detected by a flag 120. By detection of the leading end of the sheet 101 by the flag 120, starting timings of various pieces of control in an electrophotographic process described later can be determined.

A process cartridge 109 includes a photosensitive drum 105 as an image bearing member, a charging roller 106, a developing roller 107 and a toner 108. Together with the start of the printing, a high voltage is applied to the charging roller 106, so that a signal of the photosensitive drum 105 is electrically charged uniformly. The signal of the photosensitive drum 105 in an image forming range is scanned with laser light 111 emitted from an optical scanning device 110. An image pattern is formed on the photosensitive drum 105 by the optical scanning device 110, and a toner image in accordance with the first pattern on the photosensitive drum 105 is formed by the developing roller 107 to which a high voltage is applied. The toner image formed on the photosensitive drum 105 is transferred onto the sheet 101 by a transfer roller 112 to which a high voltage is applied. On the sheet 101 on which the toner image is transferred, the toner 108 is fixed by a heating device 113 and a pressing device 114 which are fixing means. The sheet 101 on which the toner 108 is fixed is discharged by a discharging roller 115, so that image formation is completed.

In the case where the image formation is continuously effected, the flag 120 detects the trailing end of the sheet 101, whereby timing when feeding of a subsequent sheet is started is determined. Further, the printer 118 includes a fan 117. The fan 117 is provided for preventing sticking of the toner 7 in the process cartridge 109 due to heat generation of the heating device 113 and for suppressing heat generation of electrical components such as an unshown power source device. Incidentally, the image forming apparatus to which the control device of the present invention is applicable is not limited to the printer 118 described with reference to FIG. 1.

[Circuit Constitution]

Figure 2:
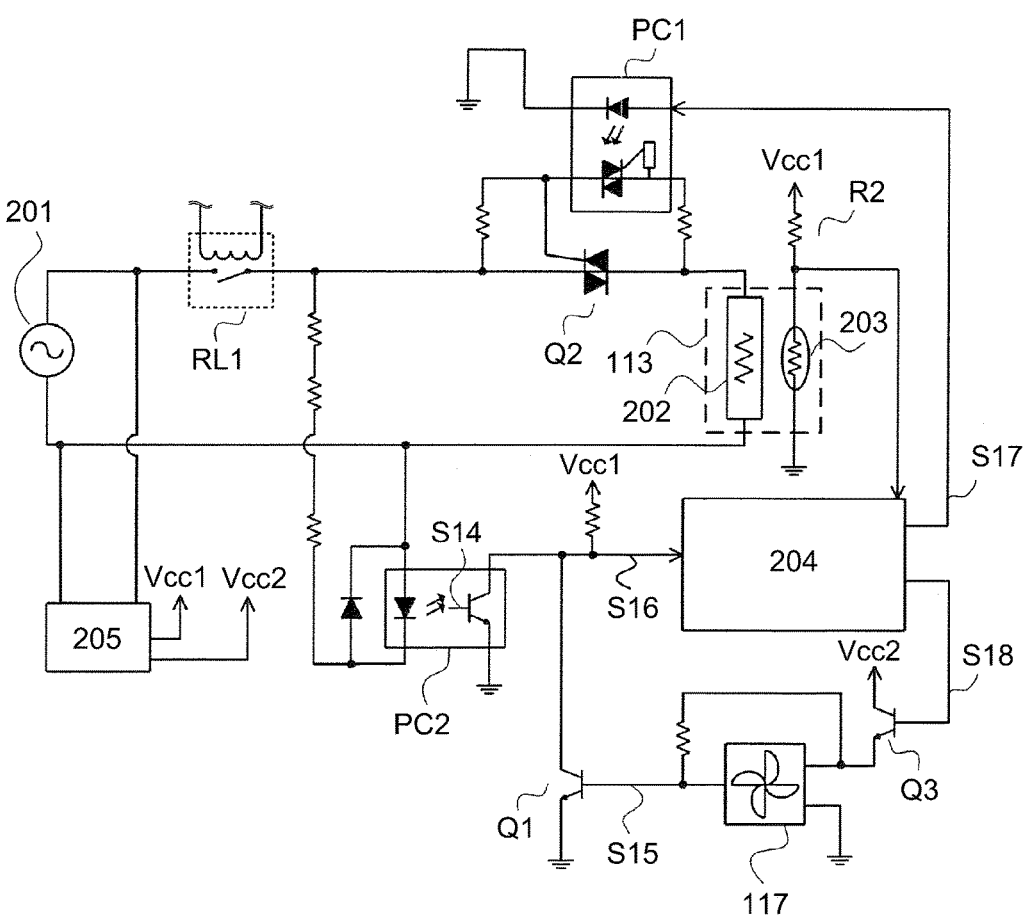
In FIG. 2, (a) is a diagram showing a circuit constitution in Embodiment 1, and (b) is a chart showing supplied electric power control in Embodiment 1.
Figure 2:
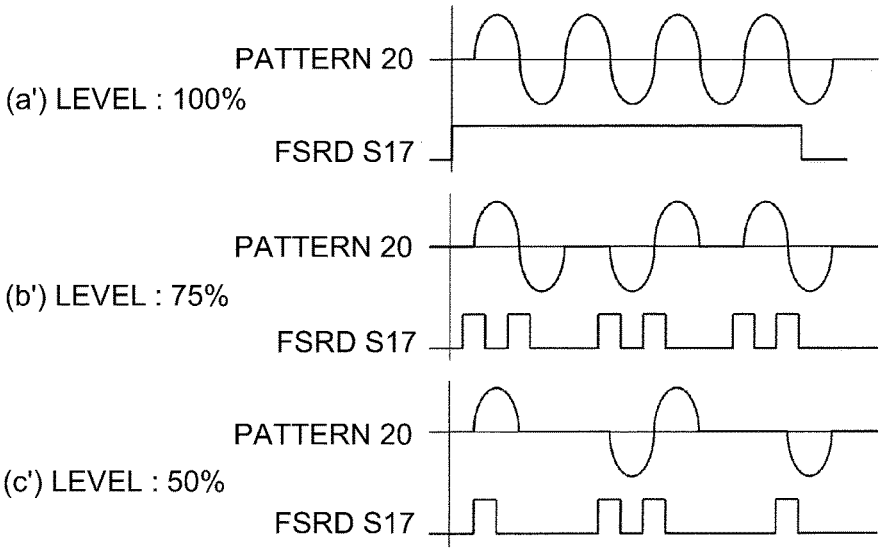

A circuit constitution in this embodiment will be described. In FIG. 2, (a) shows a constitution of a control circuit for the heating device 113 (broken-line frame portion) which is the control device in this embodiment. The control circuit in this embodiment effects control of the heating device 113 through wave-number control, but the control is, for example, phase control or combined control of the wave-number control with the phase control, and may only be required that the control is effected in synchronism with a cyclic period of a commercial power source described later. The heating device 113 includes a heat generating member 202 and a thermistor 203. Supply of electric power to the heat generating member 202 is made by a bi-directional thyristor (hereinafter referred to as a triac) Q2 and is controlled in a one have-wave unit which is a waveform of ½ of one cyclic period of an input voltage. When an on-signal (hereinafter referred to as FSRD signal S17) is outputted from a controller 204 as a control means to a photo-triac coupler PC1 (hereinafter simply referred to as PC1), a secondary-side diode of PC1 is turned on, so that a primary-side internal triac is turned on. By turning on the internal triac of PC1, a current flow through a gate of the triac Q2 and the triac Q2 is turned on, so that electric power is supplied to the heat generating member 202. Incidentally, at one side of an AC line, a relay RL1 is connected.

An amount of supply of the electric power is acquired from, e.g., a difference between a target temperature of the heat generating member 202 and a detected temperature by the thermistor 203, and is controlled so as to be the acquired amount of supply of the electric power by subjecting PC1 to on/off control. The thermistor 203 changes in resistance value by a change in temperature. For this reason, the controller 204 can detect the change in resistance value of the thermistor as a change in voltage by a voltage Vcc1 generated by a low-voltage source 205 and a pull-up resistor R2. The controller 204 can detect a temperature of the heat generating member 202 by subjecting an inputted voltage to analog-digital conversion (hereinafter referred to as A/D conversion). The low-voltage source 205 generates the PC voltage Vcc1 and a DC voltage Vcc2 from an AC voltage of the commercial power source 201.

(Control of Electric Power Supply to Heating Device)

In (b) of FIG. 2, a driving pattern of control of electric power supply to the heating device 113 is shown. From a difference between a current temperature and a target temperature, of the heat generating member 202, which are detected by the thermistor 203, a supplied electric power level is determined. In (b) of FIG. 2, (a') to (c') show different supplied electric power levels, and upper waveforms shown for the respective supplied electric power levels shows wave-number patterns 20 for supplying electric power at the associated levels. Further, each of lower waveforms show on an off of an associated FSRD signal S17 outputted from the controller 204 to PC1.

In (b) of FIG. 2, (a') shows the case where the supplied electric power level is 100%. In the case where the temperature of the heat generating member 202 detected by the thermistor 203 is lower than the target temperature and the resultant difference is large, the wave-number pattern 20 high in supplied electric power level as shown in (a') of (b) of FIG. 2 is inputted. Further, in (b) of FIG. 2, (c') shows the case where the supplied electric power level is 50%. In the case where the difference between the temperature of the heat generating member 202 detected by the thermistor 203 and the target temperature is small, the wave-number pattern 20 high in supplied electric power level as shown in (c') of (b) of FIG. 2 is inputted. Further, as in (b') of (b) of FIG. 2, it is also possible to effect control using the wave-number pattern 20 such that the supplied electric power level is 75%. Each of the FSRD signals S17 is outputted in synchronism with zero-cross timing of the AC voltage of the commercial power source 201. As a result, the wave-number pattern 20 of the AC voltage applied to the heat generating member 202 is grasped, so that the positive/negative symmetry of the AC voltage is ensured. The period of the commercial power source 201 is detected, as a periodical signal S14 which is a periodical first signal of the commercial power source 201, from the AC voltage applied to a photocoupler PC2 connected between AC lines of the commercial power source 201.

The controller 204 outputs a driving signal S18, so that the voltage Vcc2 generated by the low-voltage source 205 is applied to the fan 117. Here, as regards a transistor Q3, the driving signal S18 is inputted into a base terminal, the voltage Vcc2 is inputted into a collector terminal, and the fan 117 is connected with an either terminal. Incidentally, when the driving signal S18 is a low level, the transistor Q3 is turned off, so that the voltage Vcc2 is not supplied to the fan 117. When the driving signal S18 is a high level, the transistor Q3 is turned on, so that the voltage Vcc2 is supplied to the fan 117. As a result, the fan 117 rotates.

From the fan 117, a fan lock signal S15 which is a non-periodical second signal is outputted. The fan lock signal S15 is connected with a collector terminal of an unshown transfer in the fan 117 (hereinafter referred to as an internal transistor). In a state in which the driving signal S18 is the low level and the voltage Vcc2 is not supplied to the fan 117, the internal transfer is in an off state. At this time, the fan lock signal S15 is the low level, so that the transistor Q1 does not operate.

On the other hand, in a state in which the driving signal S18 is the high level and the voltage Vcc2 is supplied to the fan 117, the level of the fan lock signal S15 is determined depending on a rotational frequency of the fan 117. In the case where the rotational frequency of the fan 117 is less than a predetermined rotational frequency, the internal transistor is in the off state. Then, when the internal transistor is in the off state, from the fan 117, the fan lock signal S15 with the high level as a second state is outputted. Incidentally, in the case where the rotational frequency of the fan 117 is not less than a predetermined rotational frequency, the internal transistor is in an on state, so that the fan lock signal S15 is the low level as a first state. Thus, in a period until the rotational frequency of the fan 117 during actuation rises to the predetermined rotational frequency, the fan lock signal S15 with the high level is outputted. Further, also when the fan 117 is locked due to a breakdown or the like, the fan lock signal S15 with the high level is outputted.

The outputs of the two signals consisting of the periodical signal S14 and the fan lock signal S15 are wired-OR connected on a circuit and are inputted, as a multi-function signal S16 which is an input signal, into a single input port of the controller 204. Here, in the case where the fan lock signal S15 is the high level such as when the rotational frequency of the fan 117 is less than the predetermined rotational frequency or when the fan 117 is locked due to the breakdown or the like, the transistor Q1 is turned on. As regards the transistor Q1, the fan lock signal S15 is inputted into a base terminal, an emitter terminal is grounded, and a signal line of the multi-function signal S16 is connected with a collector terminal. The transistor Q1 is turned on, so that irrespective of the state of the periodical signal S14, the multi-function signal S16 is the low level as a predetermined state.

[Control in this Embodiment]

Figure 3:
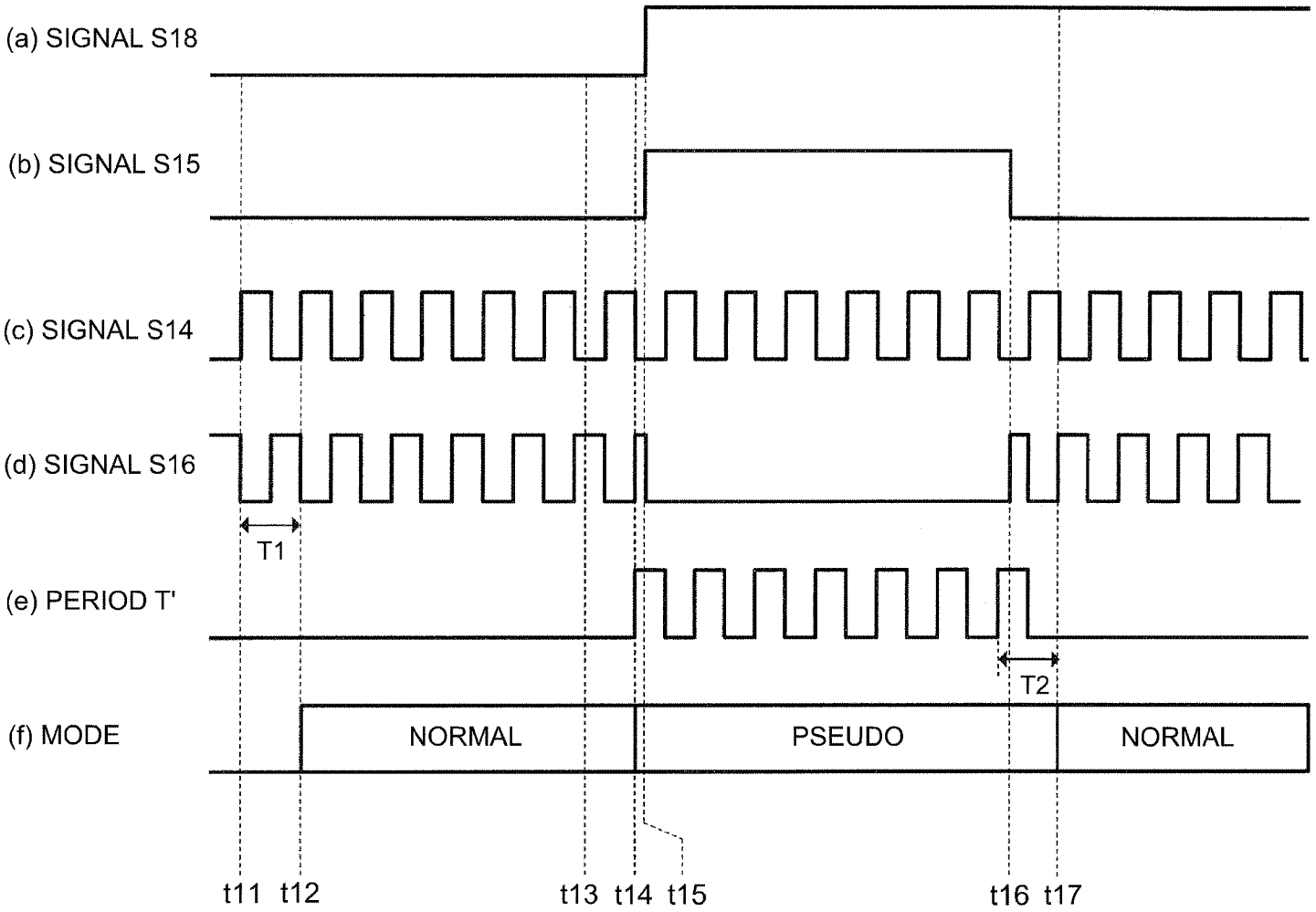
FIG. 3 is a timing chart showing control in Embodiment 1.

Next, control in this embodiment will be described using a timing chart of FIG. 3. In FIG. 3, (a) shows a signal waveform of the driving signal S18, (b) shows a signal waveform of the fan lock signal S15, (c) shows a signal waveform of the periodical signal S14, (d) shows a signal waveform of the multi-function signal S16, (e) shows a waveform of a pseudo period T' and (f) shows a control mode.

When the printer 118 receives a print job and printing is started or when the printer 118 starts an initial operation, the controller 204 turns on the relay RL1 at timing t11. When the relay RL1 is turned on at the timing t11, the AC voltage is applied to PC2, so that as shown in (c) of FIG. 3, as the periodical signal S14, a pulse signal synchronized with the period of the commercial power source 201 is outputted. At the timing t11, the controller 204 makes the driving signal S18 the low level as shown in (a) of FIG. 3. As a result, as shown in (b) of FIG. 3, also the fan lock signal S15 in the low level, and as shown in (d) of FIG. 3, as the multi-function signal S16, the periodical signal S14 is outputted, so that the controller 204 is capable of detecting the period of the commercial power source 201. Incidentally, when the periodical signal S14 is the high level, the secondary-side phototransistor of PC2 is turned on, so that the multi-function signal S16 is the low level. When the periodical signal S14 is the low level, the secondary-side phototransistor is turned off, so that the multi-function signal S16 is the high level. For this reason, the periodical signal S14 and the multi-function signal S16 are equal in period but are opposite phases.

The controller 204 detects the periodical signal S14 of the commercial power source 201, as hardware interruption using a rising edge or a falling edge of the multi-function signal S16 as a trigger. The controller 204 acquires a period T1 of the commercial power source 201 from an interval from a rising (or falling) edge of the detected periodical signal S14 to a subsequent rising (or falling) edge of the detected periodical signal S14. In this embodiment, the interval from the falling edge of the multi-function signal S16 to the subsequent falling edge of the multi-function signal S16 is the period T1.

When the period T1 of the commercial power source 201 is determined at timing t12, the controller 204 outputs an FSRD signal S17 to PC1 in synchronism with the timing of the period T1 so as not to generate deviation from zero-cross timing of the commercial power source 201. Thus, the controller 204 effects connect of electric power supplied to the heat generating member 202. In this embodiment, control using the period T1 of the commercial power source 201 is referred to as normal period control as first control (see, (f) of FIG. 3). The controller 204 detects the periodical signal S14 as the hardware interruption every input of the periodical signal 14 as the multi-function signal S16, and renews the period T1 during the normal period control to a latest period value.

Then, at timing t13 of FIG. 3, in the case where drive of the fan 117 is required depending on a temperature state of a main assembly of the printer 118, the controller 204 sets, as the pseudo period T' which is a predetermined period, the latest period T1 held when the drive of the fan 117 is required. Further, the controller 204 starts actuation of the fan 117 at timing t15, and therefore, the controller 204 outputs the driving signal S18 with the high level to the fan 117. As described above, during the actuation of the fan 117, the fan lock signal S15 with the high level is outputted until the rotational frequency of the fan 117 is not less than the predetermined rotational frequency ((b) of FIG. 3). For this reason, the multi-function signal S16 is the low level irrespective of the periodical signal S14 of the commercial power source 201 ((d) of FIG. 3).

For this reason, before the timing t15 when the actuation of the fan 117 is started, there is a need to switch the control to the control using the pseudo period T' determined at the timing t13. Here, the control using the pseudo period T' is referred to as pseudo period control as second control. After the pseudo period T' is determined at the timing t13, the controller 204 changes the control from the normal period control to the pseudo period control at timing t14 synchronized with a rising or falling edge of the periodical signal S14 after the drive of the fan 117 is required ((f) of FIG. 3). In this embodiment, synchronization is achieved at timing t14 so that the rising edge of the multi-function signal S16 is the same timing as the rising edge of the signal of the pseudo period T'. In the pseudo period control, the controller 204 generates the signal of the pseudo period T' and effects the control of the electric power supplied to the heat generating member 202 in synchronism with the signal.

The controller 204 is required to effect the following control in order to reliably detect the falling or rising edge of the multi-function signal S16 after the requirement of the drive of the fan 117. That is, the controller 204 is required to effect control so that an interval of not less than one period of the commercial power source 201 is provided from the timing t13 of the requirement of the drive of the fan 117 to the timing t15 of the start of the actuation of the fan 117. The controller 204 continues the control of the FSRD signal S17 using the pseudo period T' during the pseudo period control.

The pseudo period T' is set in a timer provided inside the controller 204, and the controller 204 outputs the FSRD signal S17 in synchronism with timer resetting. Further, the controller 204 always monitors external interruption of the multi-function signal S16. When the rotational frequency of the fan 117 is not less than the predetermined rotational frequency and the fan lock signal S15 changes from the high level to the low level, the multi-function signal S16 outputs again the signal depending on the periodical signal S14, so that the hardware interruption generates. In the case where the hardware interruption generated during the pseudo period control, the controller 204 discriminates that the actuation of the fan 117 is ended. For example, the controller 204 detects the hardware interruption from the multi-function signal S16 at timing t16 and discriminates that the actuation of the fan 117 is ended and the rotational frequency of the fan 117 is not less than the predetermined rotational frequency. At the timing t16 of the end of the actuation of the fan 117 and later timing, for example, at timing t17, the controller 204 changes the control from the control using the pseudo period T' to the original normal period control using the period T1 of the commercial power source 201.

The controller 204 effects the following control when the hardware interruption by the multi-function signal S16 is inputted during the pseudo period control at the timing t16 when the actuation of the fan 117 is ended. The controller 204 disregards a first rising edge of the multi-function signal S16 at the timing t16 and later since the first rising edge is not always synchronized with the period of the commercial power source 201. As shown in FIG. 3, at the timing t16, the periodical signal S14 of (c) and the multi-function signal S16 of (d) are not synchronized with each other. For this reason, the controller 204 detects, as the hardware interruption, a second rising edge of the multi-function signal S16 at the timing t16 and later timing. Incidentally, as shown in FIG. 3, the second multi-function signal S16 (timing t17) of (d) and the periodical signal S14 of (c) are synchronized with each other. Thus, in the case where the controller 204 detects a change in state from a state in which the low level of the multi-function signal S16 is maintained to a state depending on the periodical signal S14, the controller 204 switches the control from the pseudo period control to the normal period control in synchronism with a second change subsequent to a first change.

From an interval T2 between the second rising edge of the detected multi-function signal S16 and a rising edge of the pseudo period T' when the first rising edge of the multi-function signal S16 is inputted, the controller 204 determines, at T2, a first period T1 of the commercial power source 201 after the change to the normal period control. The controller 204 changes the control from the pseudo period control to the normal period control at the timing t17. Specifically, the controller 204 changes the control to the normal period control at the timing t17 synchronized with the second rising edge of the multi-function signal S16 after the timing t16 when the actuation of the fan t17 is ended. The controller 204 uses the above-described T2 as the period T1 of the commercial power source 201 in the control immediately after the change to the normal period control, but thereafter, the controller 204 effects control by using a period T1 acquired on the basis of the periodical signal S14 inputted as the multi-function signal S16. Further, the controller 204 renews the period T1 to a latest value.

By the above-described control, in this embodiment, even in the case where a period in which the periodical signal S14 cannot be detected during the actuation of the fan 117 generates, it is possible to continue the control of the FSRD signal S17 by the constitution in which the control is switched to the pseudo period control using the pseudo period T'.

As described above, according to this embodiment, in the constitution in which the periodical signal and the non-periodical signal are inputted into the single port of the control means, when the control using the periodical signal is effected, it is possible to continue the control irrespective of the state of the non-periodical signal.

Embodiment 2

Embodiment 2 will be described.

[Circuit Constitution]

Figure 4:
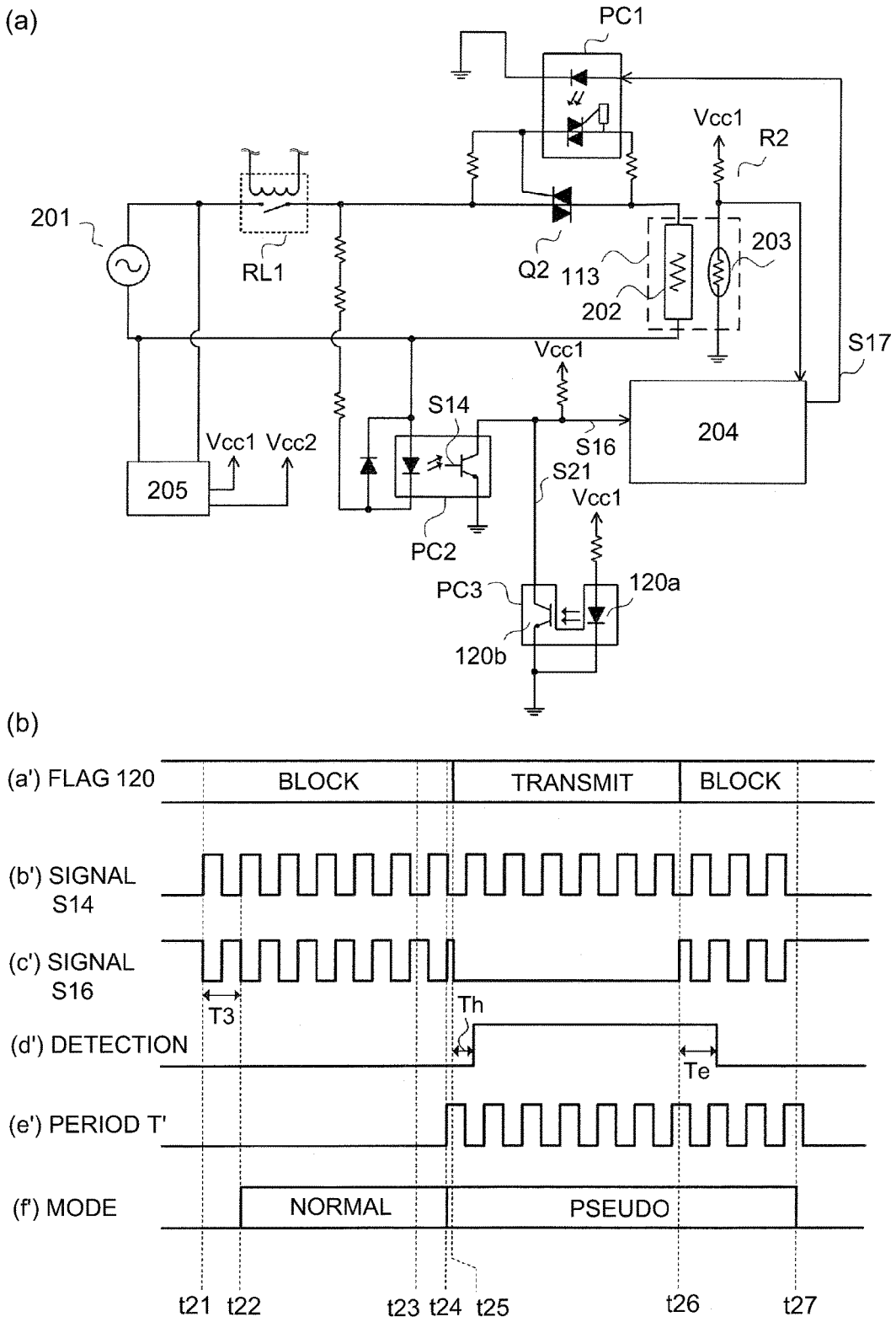
In FIG. 4, (a) is a diagram showing a circuit constitution in Embodiment 2, and (b) is a chart showing supplied electric power control in Embodiment 2.

Embodiment 2 will be described by taking a laser beam printer using an electrophotographic process as an example similarly as in Embodiment 1. A circuit constitution in this embodiment will be described using (a) of FIG. 4. In FIG. 4, (a) shows a constitution of a control circuit of a heating device 113. As regards control of electric power supplied to the heating device 113 is similar to that in the operation described in Embodiment 1, and therefore will be omitted from description. Further, constituent elements similar to those described with reference to (a) of FIG. 2 are represented by the same reference numerals or symbols and will be omitted from description.

In (a) of FIG. 4, the controller 204 detects, as a periodical signal of the commercial power source 201, the periodical signal S14 from the AC voltage applied to PC2 connected between the AC lines. A photo-interrupter PC3 (hereinafter simply referred to as PC3) detects that a leading end of the sheet 101 reached PC3 and that the trailing end of the sheet 101 passed through PC3, and outputs a signal S21 as a non-periodical second signal. The controller 204 detects the passing of the trailing end of the sheet 101 by PC3, so that the controller 204 discriminates, for example, timing of feeding of a subsequent sheet 101, occurrence or non-occurrence of paper jam on a feeding path, i.e., whether or not the printer performs a predetermined operation.

PC3 is provided together with the flag 120 on the feeding path, and the flag 120 is disposed so as to block an optical path between a light-emitting portion 120*a* and a light-receiving portion 120*b* of PC3. In a state in which the sheet 101 is not fed, the flag 120 light-blocks PC3, so that a transistor of the light-receiving portion 120*b* is not turned on and the signal S21 is in a high-impedance state which is a first state, and the multi-function signal S16 is outputted at a level depending on the periodical signal S14. On the other hand, the sheet 101 is fed and pushes the flag 120 down and the flag 120 deviates from the optical path between the light-emitting portion 120*a* and the light-receiving portion 120*b* to permit light transmission, so that the transistor of the light-receiving portion 120*b* is turned on. As a result, the signal S21 is the low level as a second state, and the multi-function signal S16 is the low level as a predetermined state irrespective of the periodical signal S14. The periodical signal S14 and the signal S21 of PC3 are wired-ON connected on the circuit and are inputted as the multi-function signal S16 into the single port of the controller 204.

[Control in this Embodiment]

A control operation in this embodiment will be described using a timing chart of (b) of FIG. 4. In (b) of FIG. 4, (a') shows a state of the flag 120 and (d') shows detection of the position of the sheet 101 by the controller 204 on the basis of an output of PC3. In (b) of FIG. 4, (b'), (c'), (e'), (f') show waveforms similar to those in (c) to (f) of FIG. 3 and will be omitted from description. When the printer 118 receives a print job and printing is started and the printer 118 starts an initial operation, the controller 204 turns on the relay RL1 at timing t21. As a result, the AC voltage is applied to PC1, so that, as the periodical signal S14 of the commercial power source 201, a pulse signal synchronized with the period of the commercial power source 201 is outputted to the controller 204, ((b') of (b) of FIG. 4).

At timing t21, the sheet 101 is in a state in which the sheet 101 is not fed (hereinafter referred to as non-feeding state, so that the flag 120 does not operate, and therefore PC3 is light-blocked by the flag 120 ((a') of (b) of FIG. 4). The signal S21 which is an output of PC3 is in a state of high impedance which is a first state. That is, the periodical signal S14 of the commercial power source 201 is outputted to the multi-function signal S16, so that the periodical signal S14 is inputted into the controller 204 through the multi-function signal S16, and the controller 204 detects the period of the commercial power source 201.

The controller 204 detects the periodical signal S14 of the commercial power source 201, as hardware interruption using a rising edge or a falling edge of the multi-function signal S16 as a trigger. The controller 204 acquires a period T3 of the commercial power source 201 from an interval from a rising or falling edge of the multi-function signal S16 to a subsequent rising or falling edge of the multi-function signal S16. In this embodiment, the interval from the falling edge of the multi-function signal S16 to the subsequent falling edge of the multi-function signal S16 is the period T3. When the period T3 is determined, at timing t22, the controller 204 outputs an FSRD signal S17 to PC1 in synchronism with the timing of the period T3 so as not to generate deviation from zero-cross timing. At timing t22 and later, in an operation in a control mode, normal period control when control using the period T3 of the commercial power source 201 is effected is made. The controller 204 detects the periodical signal S14 as the hardware interruption every input of the periodical signal 14 as the multi-function signal S16, and renews the period T3 during the normal period control to a latest period value. When the period T3 of the commercial power source 201 is determined, the controller 204 starts control of electric power supply and effects control so that the temperature of the heat generating member 202 reaches a predetermined temperature. When the heat generating member 202 rises to the predetermined temperature, feeding of the sheet 101 is started.

At the timing t23 when the feeding of the sheet 101 is started, the controller 204 sets the latest period T3, which is currently held, as the pseudo period T'.

The controller 204 changes the control from the normal period control to the pseudo period control, in which the control using the pseudo period T' is effected, at timing t24, synchronized with a rising or falling edge of the multi-function signal S16, after the timing t23 when the pseudo period T' is set. In this embodiment, synchronization is achieved at timing t24 so that the rising edge of the multi-function signal S16 is the same timing as the rising edge of the signal of the pseudo period T'.

The controller 204 is required to effect the following control in order to reliably detect the falling or rising edge of the multi-function signal S16 after the start of the feeding of the sheet at timing t23. That is, the controller 204 is required to effect control so that a time of not less than one period of the period T3 or a distance corresponding to the time is provided until the flag 120 operates from the start of the sheet feeding and PC3 changes in state from a light-blocked state to a light-transmitted state. When the control is changed to the pseudo period control at the timing t24, the controller 204 continues the control of the FSRD signal S17 in synchronism with the pseudo period T' during the pseudo period control. The pseudo period T' is set in a timer provided inside the controller 204, and the controller 204 outputs the FSRD signal S17 in synchronism with timer resetting. When the feeding of the sheet 101 is started, the sheet 101 pushes the flag 120 down at timing t25, so that the state of PC3 is changed from the light-blocked state to the light-transmitted state. For this reason, at the timing t25 and later, the multi-function signal S16 with the low level is outputted, and therefore the controller 204 cannot detect the periodical signal S14. However, at the timing t25, the control has already been changed to the pseudo period control, and therefore, the FSRD signal S17 can be outputted in synchronism with the pseudo period T', so that it is possible to continue the control of electric power supply.

Further, the controller 204 always monitors hardware interruption at the input port of the multi-function signal S16. After the change in control to the pseudo period control, in interrelation with the operation of the flag 120, a period in which the hardware interruption does not generate at the input port of the multi-function signal S16 generates. In the case where the multi-function signal S16 is still at the low level and the rising edge thereof is not detected even after a lapse of a predetermined time Th which is a first time from detection of the falling edge of the multi-function signal S16 at the timing t25, the controller 204 discriminates that the leading end of the sheet 101 reached the flag 120. Here, the predetermined time Th is set at a time of not less than ½ of the period of the commercial power source 201 ($Th \geq T3/2$), so that the controller 204 can discriminate the periodical signal S14 and detection timing of the sheet 101 by PC3.

After the leading end of the sheet 101 is detected at the timing t25, when the controller 204 detects the rising edge of the multi-function signal S16 at the timing t26, the controller 204 effects the following control. That is, in the case where the controller 204 detects the rising edge of the multi-function signal S16 again within a predetermined time Te which is a second time from the timing t26, the controller 204 discriminates that the trailing end of the sheet 101 passed through the flag 120. Here, the predetermined time Te is set so as to be not less than the period of the commercial power source 201 (Te≥T3), so that the controller 204 can discriminate the periodical signal S14 and the detection timing of the sheet 101 by PC3.

By employing the above-described constitution, the controller 204 is capable of discriminating that the leading end of the sheet 101 reached the flag 120 and that the trailing end of the sheet 101 passed through the flag 120, so that the controller 204 is capable of discriminating a feeding state of the sheet 101. The pseudo period control in this embodiment is continued until timing t27 when the feeding of the sheet 101 is ended and the control of the electric power supplied to the heating device 113 is ended. Incidentally, in this embodiment, a constitution in which after the control is changed to the pseudo period control, the pseudo period control is continued until the supplied electric power control is ended is employed, but a constitution in which the control is returned to the normal period control after the trailing end of the sheet 101 is detected may also be employed. The controller 204 not only ends the supplied electric power control by turning off the relay RL1 at the timing t27 but also reset the pseudo period T' set in the timer and ends the pseudo period control. By effecting the control described above, even in a constitution in which the multi-function signal S16 functioning as both of the periodical signal S14 and the signal S21 of PC3 is inputted, the controller 204 can continue the control of the electric power supplied to the heat generating member 202.

As described above, according to this embodiment, in the constitution in which the periodical signal and the non-periodical signal are inputted into the single port of the control means, when the control using the periodical signal is effected, it is possible to continue the control irrespective of the state of the non-periodical signal.

Embodiment 3

[Control in this Embodiment]

Embodiment 2 will be described by taking a laser beam printer using an electrophotographic process as an example similarly as in Embodiments 1 and 2. In this embodiment, images are continuously formed on a plurality of sheets 101. A circuit constitution in this embodiment is similar to that in (a) of FIG. 4 in Embodiment 2 and will be omitted from description. A control operation in this embodiment will be described using a timing chart of FIG. 5.

Figure 5:
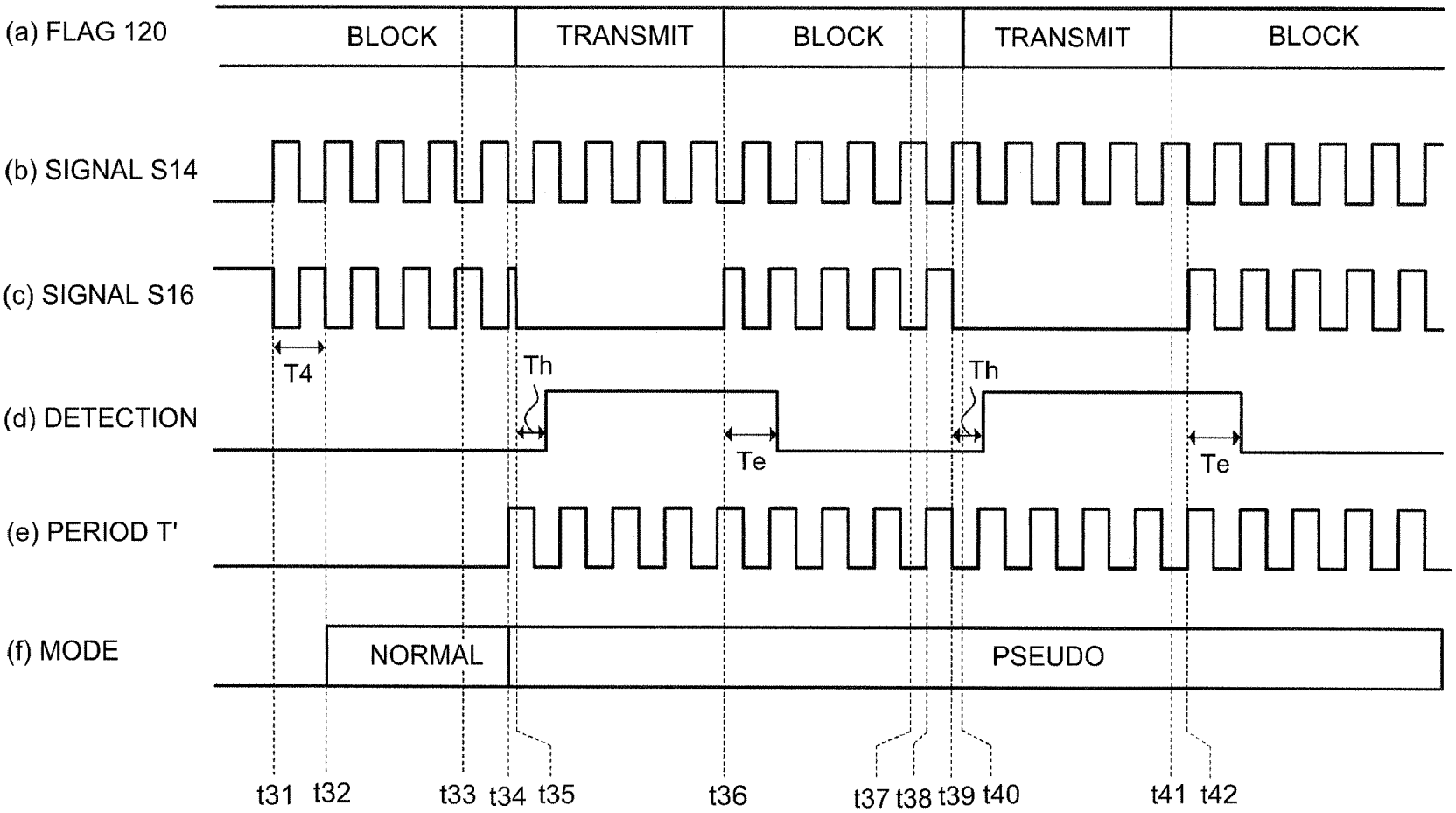
FIG. 5 is a timing chart showing control in Embodiment 2.
Figure 6:
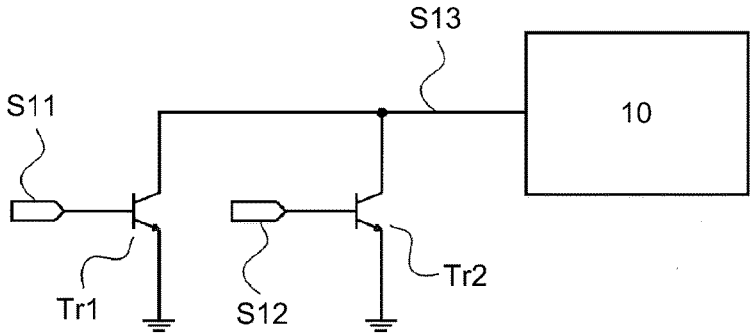
In FIG. 6, (a) is a diagram showing a circuit constitution in a conventional example, and (b) is a timing chart showing control in the conventional example.
Figure 6:
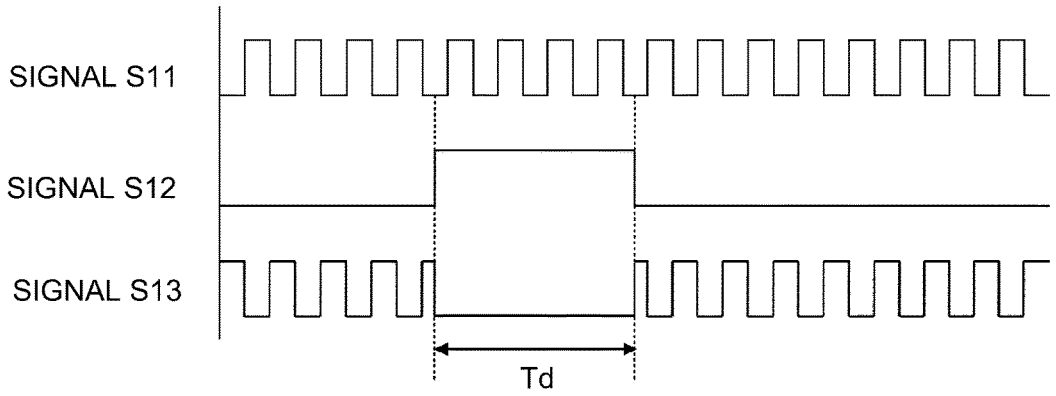

In FIG. 5, (a) to (f) show waveforms similar to those in (c) to (f) of FIG. 3 and will be omitted from description. When the printer 118 receives a print job and printing is started and the printer 118 starts an initial operation, the controller 204 turns on the relay RL1 at timing t31. As a result, the AC voltage is applied to PC1, so that, as the periodical signal S14 of the commercial power source 201, a pulse signal synchronized with the period of the commercial power source 201 is outputted to the controller 204, ((b) of FIG. 5).

At timing t31, the flag 120 does not operate in the non-feeding state, and therefore PC3 is light-blocked by the flag 120 ((a) of FIG. 5). The signal S21 which is an output of PC3 is in a state of high impedance. That is, the periodical signal S14 of the commercial power source 201 is outputted to the multi-function signal S16, so that the multi-function signal S16 is inputted into the controller 204, and the controller 204 detects the period of the commercial power source 201.

The controller 204 detects the periodical signal S14 of the commercial power source 201, as hardware interruption using a rising edge or a falling edge of the multi-function signal S16 as a trigger. The controller 204 acquires a period T3 of the commercial power source 201 from an interval from a rising or falling edge of the multi-function signal S16 to a subsequent rising or falling edge of the multi-function signal S16. In this embodiment, the interval from the falling edge of the multi-function signal S16 to the subsequent falling edge of the multi-function signal S16 is the period T4.

When the period T4 is determined, at timing t32, the controller 204 outputs an FSRD signal S17 to PC1 in synchronism with the timing of the period T4 so as not to generate deviation from zero-cross timing. At timing t32 and later, in an operation in a control mode, normal period control when control using the period T4 of the commercial power source 201 is effected is made. The controller 204 detects the periodical signal S14 as the hardware interruption every input of the periodical signal 14 as the multi-function signal S16, and renews the period T4 during the normal period control to a latest period value. When the period T4 of the commercial power source 201 is determined, the controller 204 starts control of electric power supply and effects control so that the temperature of the heat generating member 202 reaches a predetermined temperature. When the heat generating member 202 rises to the predetermined temperature, feeding of a first sheet 101 is started.

At the timing t33 when the feeding of the first sheet 101 is started, the controller 204 sets the latest period T3, which is currently held, as the pseudo period T'. The controller 204 changes the control from the normal period control to the pseudo period control, in which the control using the pseudo period T' is effected, at timing t34, synchronized with a rising or falling edge of the multi-function signal S16, after the timing t33 when the pseudo period T' is set. In this embodiment, synchronization is achieved at timing t34 so that the rising edge of the multi-function signal S16 is the same timing as the rising edge of the signal of the pseudo period T'.

When the control is changed to the pseudo period control at the timing t34, the controller 204 continues the control of the FSRD signal S17 in synchronism with the pseudo period T' during the pseudo period control. The pseudo period T' is set in a timer provided inside the controller 204, and the controller 204 outputs the FSRD signal S17 in synchronism with timer resetting.

The controller 204 is required to effect the following control in order to reliably detect the rising or falling edge of the multi-function signal S16 after the start of the sheet feeding at the timing t33. That is, the controller 204 is required to effect control so that a time of not less than one period of the period T4 or a distance corresponding to the time is ensured until the flag 120 operates from the start of the sheet feeding and PC3 changes in state from a light-blocked state to a light-transmitted state. When the feeding of the first sheet 101 is started, the first sheet 101 pushes the flag 120 down at timing t35, so that the state of PC3 is changed from the light-blocked state to the light-transmitted state. For this reason, at the timing t35 and later, the multi-function signal S16 with the low level is outputted, and therefore the controller 204 cannot detect the periodical signal S14. However, at the timing t35, the control has been changed to the pseudo period control, and therefore, the FSRD signal S17 can be outputted in synchronism with the pseudo period T', so that it is possible to continue the control of electric power supply.

Further, the controller 204 always monitors hardware interruption at the input port of the multi-function signal S16. After the change in control to the pseudo period control, in interrelation with the operation of the flag 120, a period in which the hardware interruption does not generate at the input port of the multi-function signal S16 generates. In the case where the rising edge thereof is not detected even after a lapse of a predetermined time Th from detection of the falling edge of the multi-function signal S16 at the timing t39, the controller 204 discriminates that the leading end of the first sheet 101 reached the flag 120. Here, the predetermined time Th is set at ½ of the period of the commercial power source 201 (Th=T4/2) or more, so that the controller 204 can discriminate the periodical signal S14 and detection timing of the first sheet 101 by PC3.

After the leading end of the sheet 101 is detected at the timing t35, when the controller 204 detects the rising edge of the multi-function signal S16 at the timing t36, the controller 204 effects the following control. That is, in the case where the controller 204 detects the rising edge of the multi-function signal S16 again within a predetermined time Te from the timing t36, the controller 204 discriminates that the trailing end of the first sheet 101 passed through the flag 120. Here, the predetermined time Te is set so as to be not less than the period (T4) of the commercial power source 201, so that the controller 204 can discriminate the periodical signal S14 and the detection timing of the first sheet 101 by PC3.

By employing the above-described constitution, the controller 204 is capable of discriminating that the leading end of the sheet 101 reached the flag 120 and that the trailing end of the sheet 101 passed through the flag 120, so that the controller 204 is capable of discriminating a feeding state of the sheet 101. In the case where the sheets are continuously fed, a sheet feeding interval depending on a feeding speed and a throughput generates between a sheet 101 and a subsequent sheet 101. At the timing t36 when the trailing end of the first sheet 101 passed through the flag 120, PC3 is in the light-blocked state, so that the signal S21 outputted from PC3 is in a high-impedance state. For this reason, to the multi-function signal 16, the periodical signal S14 of the commercial power source 201 is outputted again.

The controller 204 always monitors a pulse signal of the multi-function signal S16 as the hardware interruption of the input port, and detects and calculates the interval between the rising or falling edges of the multi-function signal S16. The controller 204 stores (holds) the detected interval between the edges of the period T4 of the commercial power source 201 in the internal memory. The controller 204 renews the period T4 to a latest period value in the sheet interval between the first and second sheets 101.

The controller 204 provides a predetermined sheet interval at the timing t36 when the trailing end of the first sheet 101 is detected by PC3 and at later timing, and starts the feeding of the second sheet 101 at timing t37. Immediately after the timing t37 when the feeding of the second sheet 101 is started, at timing t38 synchronized with the rising or falling edge of the pseudo period T', the controller 204 renews the pseudo period T' to a latest period T4 of the commercial power source 201 held in the internal memory. In this embodiment, the controller 204 renews the pseudo period T' at the timing t38 synchronized with the rising edge of the pseudo period T'. Thus, the controller 204 repeats the renewal of the pseudo period T' during the sheet intervals until the feeding is ended. When the feeding of the second sheet 101 is started, the second sheet 101 pushes the flag 120 down at timing t40, so that the state of PC3 is changed from the light-blocked state to the light-transmitted state. For this reason, at the timing t40 and later, the multi-function signal S16 with the low level is outputted, and therefore the controller 204 cannot detect the periodical signal S14. However, the timing t40 has already been during the pseudo period control, and therefore, the FSRD signal S17 can be outputted in synchronism with the pseudo period T', so that it is possible to continue the control of electric power supply.

Further, the controller 204 always monitors hardware interruption at the input port of the multi-function signal S16. During the pseudo period control, in interrelation with the operation of the flag 120, a period in which the hardware interruption does not generate at the input port of the multi-function signal S16 generates. In the case where the rising edge thereof is not detected even after a lapse of a predetermined time Th from detection of the falling edge of the multi-function signal S16 immediately before the timing t40, the controller 204 discriminates that the leading end of the first sheet 101 reached the flag 120. Here, the predetermined time Th is set at ½ of the period of the commercial power source 201 (Th=T4/2) or more, so that the controller 204 can discriminate the periodical signal S14 and detection timing of the second sheet 101 by PC3.

After the leading end of the second sheet 101 reached the flag 120 at the timing t40, the trailing end of the second sheet 101 passes through the flag 120 at timing t41. When the controller 204 detects the rising edge of the multi-function signal S16 at timing t42, the controller 204 effects the following control. That is, in the case where the controller 204 detects the rising edge of the multi-function signal S16 again within a predetermined time Te from the timing t42, the controller 204 discriminates that the trailing end of the second sheet 101 passed through the flag 120. Here, the predetermined time Te is set so as to be not less than the period (T4) of the commercial power source 201, so that the controller 204 can discriminate the periodical signal S14 and the detection timing of the second sheet 101 by PC3.

By employing the above-described constitution, the controller 204 is capable of discriminating that the leading end of the sheet 101 reached the flag 120 and that the trailing end of the sheet 101 passed through the flag 120, so that the controller 204 is capable of discriminating a feeding state of the sheet 101. When image formation on a final sheet in continuous printing is ended, the controller 204 not only ends the supplied electric power control by turning off the relay RL1 but also reset the pseudo period T' set in the timer and ends the pseudo period control. By effecting the control described above, even in a constitution in which the multi-function signal S16 functioning as both of the periodical signal S14 and the signal S21 of PC3 is inputted, the controller 204 can continue the control of the electric power supplied to the heat generating member 202.

Incidentally, in this embodiment, after the sheet feeding of the first sheet 101 is started and the control is changed from the normal period control to the pseudo period control, the pseudo period control is continued until the supplied electric power control is ended. However, a constitution in which the control is changed from the pseudo period control to the normal period control after the first sheet 101 passed through the flag 120 may also be employed. Further, a constitution in which the control is changed from the normal period control to the pseudo period control before the second sheet 101 reaches the flag 120 by being effected similarly as in the case of the first sheet 101 may also be employed. That is, in the sheet interval between consecutive sheets, control returned to the normal period control may also be effected.

By effecting the control described above, it is possible to continue the control of the electric power supplied to the heat generating member 202 on the basis of the commercial power source period while using the periodical signal S14 and the signal S21 of the flag 120 and PC3 as the multi-function signal S16.

As described above, according to this embodiment, in the constitution in which the periodical signal and the non-periodical signal are inputted into the single port of the control means, when the control using the periodical signal is effected, it is possible to continue the control irrespective of the state of the non-periodical signal.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-240229 filed on Dec. 9, 2015, which is hereby incorporated by reference herein in its entirety.

What is claimed is:

1. A control device comprising:

a controller configured to control an operation of a first load and a second load, said controller including an input port and further being configured for selectively receiving a periodical first signal corresponding to an AC voltage and a non-periodical second signal generated from said second load through said input port and for controlling the operation of said first load based on the first signal, wherein said controller controls the operation of said first load based on the first signal during a period of receiving the first signal and non-receiving the second signal, and generates a pseudo first signal and controls the operation of said first load based on the pseudo first signal during a period of non-receiving the first signal and receiving the second signal.

2. The control device according to claim 1, wherein said controller switches a first state in which said second load is operated and a second state in which said second load is not operated, and receives the second signal in a case where said second load is in the second state.

3. The control device according to claim 2, wherein said controller outputs a signal changing in the state of said second load to said second load.

4. The image forming apparatus for forming an image on a recording material, comprising:

a controller configured to control an operation of a first load and a second load, said controller including an input port and further being configured for selectively receiving a periodical first signal corresponding to an AC voltage and a non-periodical second signal generated from said second load through said input port and for controlling the operation of said first load based on the first signal, wherein said controller controls the operation of said first load based on the first signal during a period of receiving the first signal and non-receiving the second signal, and generates a pseudo first signal and controls the operation of said first load based on the pseudo first signal during a period of non-receiving the first signal and receiving the second signal.

5. The image forming apparatus device according to claim 4, wherein said controller switches a first state in which said second load is operated and a second state in which said second load is not operated, and receives the second signal in a case where said second load is in the second state.

6. The image forming apparatus device according to claim 5, wherein said controller outputs a signal changing in the state of said second load to said second load.

7. The image forming apparatus according to claim 6, wherein said second load includes a fan for outputting the second signal in the second state when a rotational frequency is less than a predetermined rotational frequency, wherein when a demand for drive of said fan is made, said controller determines a cyclic period of the pseudo first signal on the basis of a cyclic period of the first signal.

8. The image forming apparatus according to claim 7, wherein said controller starts the drive said fan at timing when a time of not less than one cyclic period of the first signal has elapsed from timing when the demand for the drive of said fan is made.

9. The image forming apparatus according to claim 8, wherein after the demand for the drive of said fan is made and before the drive of said fan is started, said controller switches the control from the first control to the second control.

10. The image forming apparatus according to claim 5, further comprising a detecting portion for outputting the second signal in the second state when the recording material is detected and for outputting the second signal in the first state when the recording material is not detected, wherein when feeding of the recording material is started, said controller determines a cyclic period of the pseudo first signal on the basis of a cyclic period of the first signal.

11. The image forming apparatus according to claim 10, wherein when an inputted signal is still in a predetermined state even after a lapse of a first time from timing when the inputted signal is in the predetermined state, said controller discriminates that a leading end of the recording material reached said detecting portion.

12. The image forming apparatus according to claim 11, wherein the first time is a time not less than ½ of the cyclic period of the first signal.

13. The image forming apparatus according to claim 12, wherein after the feeding of the recording material is started and before the inputted signal is in the predetermined state, said controller switches the connect from the first control to the second control in synchronism with the first signal.

14. The image forming apparatus according to claim 13, wherein said controller monitors the port even after the connect is switched to the second control, and wherein when a change in state of the inputted signal from the predetermined state to a state depending on the first signal is detected and the state of the inputted signal is still in the state depending on the first signal even when a second time has elapsed from timing of the change, said controller discriminates that a trailing end of the recording material passed through said detecting portion.

15. The image forming apparatus according to claim 14, wherein the second time is a time not less than ½ of one cyclic period of the first signal.

16. The image forming apparatus according to claim 10, wherein when a plurality of recording materials are fed, said controller renews a cyclic period of the pseudo first signal on the basis of the cyclic period of the first signal.

17. The image forming apparatus according to claim 4, further comprising a fixing portion including a heat generating member, wherein said first load includes said heat generating member, and wherein said controller effects connect for supplying electric power to the heat generating member in synchronism with the first signal or the pseudo first signal.

18. A control device comprising:

a controller configured to control an operation of a first load;

an output port provided with said controller, configured to output a control signal to said first load; and an input port provided with said controller, configured to input an input signal which is superimposed on a periodical first signal corresponding to said first load and a second signal indicating a state of a second load, wherein said controller detects the first signal based on the input signal, acquires a cyclic period of the first signal detected by said controller every input of the first signal, and wherein said controller outputs the control signal to said first load based on the first signal during a period of detecting the first signal, and generates a pseudo first signal based of the cyclic period which is latest acquired and outputs the control signal to said first load based on the pseudo first signal during a period of non-detecting the first signal.

19. A control device according to claim 18, wherein the first signal corresponds to an AC voltage, said first load includes a fixing portion, and said second load includes at least one of a fan and a sheet feeding portion.

* * * * *